United States Patent [19]

Becherer

[11] Patent Number: 4,545,315

[45] Date of Patent: Oct. 8, 1985

[54] REMOTE CONTROL WATER FOWL RETRIEVING DEVICE

[76] Inventor: Daryl Becherer, 2015 Camp Jackson Rd., Cahokia, Ill. 62206

[21] Appl. No.: 623,150

[22] Filed: Jun. 21, 1984

[51] Int. Cl.[4] ..... B63B 1/00

[52] U.S. Cl. ..... 114/61; 114/144 R; 43/1

[58] Field of Search ..... 114/61, 144 R, 256, 114/270; 43/1; 210/923; 446/200, 202; 441/80, 83, 129, 132

[56] References Cited

U.S. PATENT DOCUMENTS

| | | | |
|---|---|---|---|
| 2,857,702 | 10/1958 | Erdman | 43/1 |
| 3,026,545 | 3/1962 | Brainard, II | 114/270 |
| 3,370,310 | 2/1968 | Latour | 441/80 |
| 4,020,777 | 5/1977 | Brown et al. | 114/61 |

FOREIGN PATENT DOCUMENTS

| | | | |
|---|---|---|---|
| 729870 | 3/1966 | Canada | 43/1 |
| 1177776 | 1/1970 | United Kingdom | 114/270 |

*Primary Examiner*—Jesûs D. Sotelo

*Attorney, Agent, or Firm*—Haverstock, Garrett & Roberts

[57] ABSTRACT

A device for retrieving objects floating on the surface of a body of water by remote control thereof including a housing portion including a pair of forwardly extending spaced-apart pontoon members streamlined in shape and a housing member extending therebetween, a forwardly projecting scoop pivotally mounted on the housing member and extending forwardly therefrom between the pontoon members and movable between a raised and a lowered position, a drive circuit operatively connected to the scoop to produce movements thereof, a propulsion motor with a propeller mounted on the housing portion in position extending therefrom to below the surface of the body of water supporting the device, a steering mechanism and associated drive motor therefor mounted extending from the body portion to adjacent the propeller, a radio receiver device and associated control circuits including a source of energy located in the housing portion, said control circuits including mechanisms for controlling the energizing and the direction of energizing of the scoop drive circuit, the propulsion motor and the drive motor for the steering mechanism under control of signals received by the radio receiver device.

18 Claims, 8 Drawing Figures

REMOTE CONTROL WATER FOWL RETRIEVING DEVICE

The present invention relates generally to a remote controlled device for retrieving water fowl such as ducks and geese shot down over open water. More specifically, the device is a dual pontoon construction having a housing connecting the pontoons at the rear thereof and containing a radio receiver, a battery, a control circuit and associated actuators, and beneath which is located a propulsion motor and steering mechanism. A rack is positioned extending forwardly from the housing between the pontoons and is pivotal about its rear end to enable it to be moved downwardly into the water below a downed water fowl or other object and thereafter to lift the fowl off the water for transport in a raised position. The device is operated remotely much like a remote controlled model airplane and includes a control circuit for selectably controlling steering, rack movement and rudder direction. The drive motor for moving the device through the water may be a motor like a trolling motor. One or more controllable rudders are provided to steer the device, which rudders are operable by solenoid or other motor devices. The device also includes a transmitter device operable by a hunter or other person for the remote control thereof.

When the device is on the water, it can be powered and guided remotely to a downed water fowl such as to a duck, and, when the device is properly positioned, the movable rack located between the spaced pontoons is lowered under control of the remote control transmitter device so that the rack can be moved under the downed water fowl. Thereafter, the rack is moved upwardly to raise the water fowl above the water. The device can then be guided back to where the hunter is located.

The device is primarily for use by duck and goose hunters to retrieve birds shot over open water. It can also be used for other purposes such as placing and retrieving decoys or retrieving other objects that it is capable of lifting from the water's surface and carrying. Once a fowl is removed from the device by the hunter, the device is ready to go out again. The device can also be used to herd crippled water fowl such as to drive a wounded bird closer so that it can be killed. It can also be used to reposition decoys. Other uses envisioned for the device include recovery of objects blown or dropped into the water, assistance in the rescue of a hunter or other person who has fallen overboard, and transportation of objects across the water for some purpose.

PRIOR ART

The closest known prior art device to the present device is disclosed in Brainard II U.S. Pat. No. 3,026,545. The Brainard II device includes a single compartment shallow hull on which is mounted a motor and propulsion screw, a rudder for steering, a remotely controllable means for motor and rudder control, an antenna and a plurality of forwardly projecting arms for guiding and holding a floating object as it is pushed, not carried, over the water. The Brainard II device is used by remotely guiding the device to a downed water fowl, positioning the device to line up the forwardly projecting arms with the downed fowl, and moving the device forward to engage the fowl. The device is then remotely energized to push the water fowl through the water toward the hunter. The Brainard II patent discloses the use of a remote control system which utilizes two different types of radio signal pulses to control its operation. These pulses are used to effect the movement of a plurality of cams located inside the device, which cams engage and disengage various contacts for rudder movement and motor switching.

The present invention differs from the Brainard II device in many substantial respects. For example, the present device is a twin hull construction with each hull member being streamlined to minimize resistance to water during movement and the hull members are spaced apart from each other to provide efficient and stable load carrying characteristics when carrying an object such as a water fowl. The present device includes a pivotal forwardly extending rack or scoop positioned extending forwardly from near the rear end of the device to between the two hulls which rack can be raised and lowered as aforesaid and when carrying an object to be transported, helps to maintain the device in a balanced and stable condition since the object or fowl therein is located between the two hulls. The Brainard II device, on the other hand, has no carrying capabilities. Its forwardly projecting arms or rods extend from the front end of the device and act to engage the water fowl or other object while the object remains floating on the water as it is being pushed across the water during retrieval. The pushing action is irratic and difficult to control; it causes the device to also push objects such as weeds and sticks that may be in the way, and the object being pushed as well as other objects encountered produces considerable drag on the device making movement slow, unstable and difficult to steer. The rack or scoop of the present device, on the other hand, lifts the object preferably clear of the water so that there is minimal drag or resistance to movment and so that the present device can be maintained in a balanced, relatively stable and easily controlled condition as it is being guided in its movement over the water. The shape and construction of the movable rack also reduces the possibility of loss of the raised fowl being transported, especially under conditions where the fowl may not be dead and where there may be a need to back the device out of a tight location. This is not possible with the Brainard II device because not only is it incapable of raising the fowl off the water but it is not possible to back the Brainard II device up, and if it were possible to back the Brainard II device up, it would move away from the object it is pushing and lose control thereof. The shape and construction of the movable rack in the present device also minimizes the possibility of an injured water fowl escaping for the reason that the floor and parts of the sides of the rack are preferably formed of string or wire like materials which form openings that help to trap the fowls feet, wings and head so that it is difficult for the fowl to extricate himself once he is in the rack. The Brainard II device does not have anything equivalent to the rack of the present device.

The present invention also differs from the Brainard II device in that it has better control and maneuvering capabilities, it is relatively simpler to control and operate and it can be operated over a relatively large range including on relatively large water bodies and under relatively windy conditions.

Another device which is of limited interest to show the state of the art is disclosed in LeTour U.S. Pat. No. 3,370,310. This patent shows a tiltable lift frame which is for use on small boats. The device is formed of tubular pipe members and is attachable to the front end of a boat for use in lifting a stretcher with an injured person thereon from the water without much risk of upsetting the boat. The present device differs substantially both structurally and operationally from the device disclosed in the LeTour patent.

The present invention teaches the construction of a water fowl retrieving device with dual pontoons connected together adjacent to their rear ends by a housing and the device includes a rack projecting forwardly from the housing between the pontoons which rack is pivotal on the housing between raised and lowered positions by means under control of a remote control device.

It is a principle object of the present invention to teach the construction and operation of a novel remotely controllable device for the retrieval of water fowl downed over open water.

Another object is to make it possible to retrieve objects from the water surface over relatively great distances by means which can be controlled remotely.

Another object is to teach the use of remotely controllable means for lifting and transporting an object from the water surface.

Another object is to teach the construction of means movable to a position under a floating object and movable to lift the object from the water so that the object may be transported across the water with minimal resistance to movement.

Another object is to teach the construction of a device for more efficiently and accurately retrieving objects floating on the water surface.

Another object is to provide relatively simple to operate and control means for retrieving objects from the water's surface.

Another object is to teach the construction of a relatively stable device for supporting objects when they are retrieved from the water.

Another object is to provide a versatile, highly manueverable device which can be accurately controlled and guided even at great distances over a body of water.

Another object is to teach a retrieval device which can be used in relatively rough and choppy water and under fairly windy conditions.

Another object is to teach the construction of a water fowl retrieving device which produces minimal interference with hunting as downed fowl are being retrieved.

Another object is to make the hunting of water fowl on open water a more enjoyable sport.

Another object is to reduce the loss of downed water fowl.

These and other objects and advantages of the present invention will become apparent to those skilled in the art after considering the following detailed specification of a preferred embodiment of the present device in conjunction with the accompanying drawings, wherein.

Figure 1:
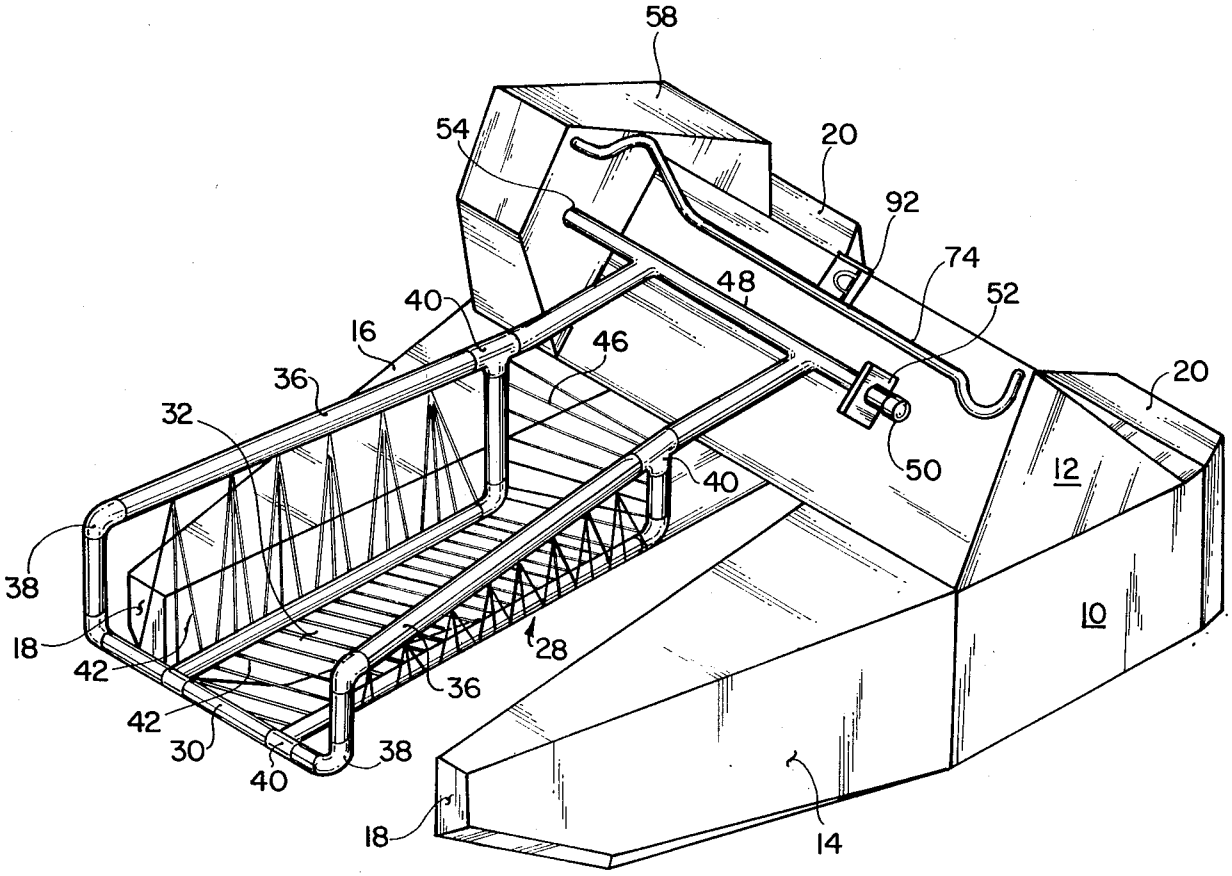
FIG. 1 is a perspective view of a water fowl retrieval device constructed according to the present invention.

Referring to the drawings more particularly by reference numbers wherein like numerals refer to like parts, FIG. 1 shows the remotely controllable water fowl retrieving device 10 constructed according to the teachings of the present invention. The retrieval device 10 includes a housing structure 12 which is located near the rear of the device and is connected to first and second spaced parallel buoyant pontoons 14 and 16 extending forwardly therefrom. The housing 12 is shown extending between the upper portions of the pontoons so that it is spaced above the water when the device is floating. The housing 12 contains the circuitry and other controls for the device including signal receiver means which receives signals that are used to control the operation of the device 10. The circuitry and the controls associated therewith will be described more fully in connection with FIG. 5.

The buoyant pontoons 14 and 16 are shown as being streamlined in shape, tapering from narrower, forward ends 18 to wider, rearward ends 20 where they are connected to the housing 12. They may also become narrow or more pointed at their rear ends 20 to facilitate movement in a rearward direction. This pontoon shape enables the device to move over the water with minimal resistance and with a high degree of stability. The wider rearward portions 20 of the pontoons 14 and 16 also provide additional floatational support for the relatively heavy elements found inside the control housing 12 and for the propulsion motor 66 which extends downwardly from the housing 12. The pontoons are preferably constructed of a relatively strong, durable and lightweight material and, in the preferred embodiment, the pontoons 14 and 16 are constructed with a styrofoam core 22 which is covered by a layer of protective material 24 such as fiberglass. Such materials are relatively inexpensive and easy to form into the desired shape and can also withstand rough handling without breaking or losing their buoyancy. The control housing 12 is also preferably constructed of a relatively lightweight, durable substance 26, such as marine plywood, shown covered by a protective layer 24, such as fiberglass fabric. It is also contemplated to construct the housing 12 and the pontoons 14 and 16 of injection molded fiberglass or a like substance. The important thing is to make the device lightweight and strong, unsinkable, and preferably, to make it compact for easy transportation and storage.

Figure 3:
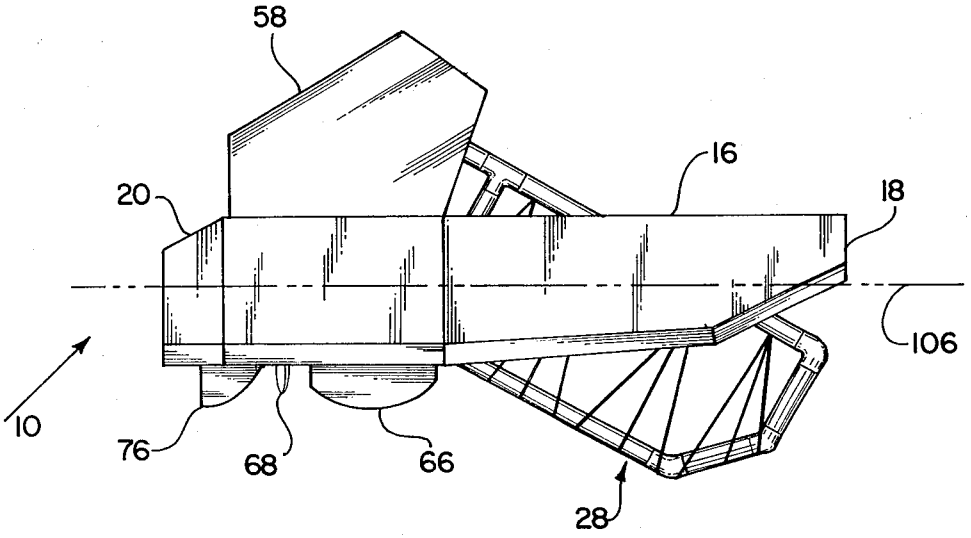
FIG. 3 is a side elevational view of the device of FIG. 1 with the movable rack portion thereof shown in lowered position.

Located between the forwardly extending pontoons 14 and 16 is a forwardly projecting rack or scoop 28 which is pivotally attached the housing 12 and is used to hold and support an object such as a downed water fowl during transportation over the water. The forward end 30 of the rack 28 may extend to or even beyond the forward ends 18 of the pontoons 14 and 16 and may be somewhat wider than the rest of the rack 28 to more completely fill the space beween the pontoons 12 and 14 and to aid in capturing and lifting an object, such as a duck, as the object moves against the rack when the rack 28 is in its lowered position in the water (FIG. 3). The bed portion 32 of the scoop 28 may also angle upwardly at its forward end 30 when in its raised position (FIG. 1) so that an object which is positioned thereon will tend to move rearwardly thereon so as not to be lost during transportation thereof.

The rack or scoop 28 is preferably formed of tubular members 36 which may be metal or plastic tubular members and which are connected together by welding or by using various devices such as elbows 38 and T-connections 40. Plastic plumbing pipes are suitable for this purpose. The tubular members 36, which should be relatively strong and lightweight, frame the rack 28 and provide support for cord members 42, such as fishing-type line, which is attached thereto as by being wrapping it around the tubular members 36 or threaded through openings in the tubular members 36. The end members form an open grid construction for the sides 44, rear 46 and bottom 32 of the rack which is a highly desirable construction because it makes for a light-weight rack construction and a construction that allows objects, such as water fowl, to be positioned therein with their legs and wings becoming enmeshed with the cords 42 making it difficult for them to move and difficult for them to extricate themselves should they be alive but wounded when they are picked up. The open design of the rack 28 also produces minimal resistance to movement in the water when it is moved up and down and it resists water and algae from accumulating in the rack 28 and adding to the weight thereof. Thus, the device is prevented from becoming excessively loaded as it is maneuvered over the water to return a downed water fowl to the hunter. It is also contemplated to use an open mesh fabric instead of the cord members 42 but this only adds to the expense without offering any additional advantages.

The tubes 36 of the rack 28 are fixedly attached to a cross-bar member 48, which cross-bar member 48 is rotatably supported adjacent to one end 50 by a bracket 52 attached to the housing 12 and is connected at the other end 54 to a reduction gear mechanism 56 (FIG. 2) located inside of a housing portion 58. The reduction gear mechanism 56 is operatively connected to the shaft 60 of a reversible motor 62, which, when operated in one direction rotates the cross-bar 48 to lower the rack 28 to the position shown in FIG. 3, and, when operated the other direction rotates the cross-bar 48 to raise the rack 28 to the positon shown in FIG. 1. The reversible rack or scoop motor 62 is operatively connected to a control circuit including radio receiver means 100 which receives radio signals from a remote location and converts the radio signals to control signals for controlling the direction and operation of the motor 62 by controlling its connection to a battery or other source of energy. The control circuit and radio receiver means will be described more fully in conjunction with FIG. 5.

Extending downwardly from the housing 12 in the space 64 (FIG. 4) between the pontoons 14 and 16 is a propulsion motor 66 including a propeller 68. The propulsion motor 66 may be a conventional trolling motor or the like modified to reduce the length of the shaft 70 which extends upwardly therefrom to the housing 12 to which it is attached by bracket 72. The motor 66 is preferably reversible as by reversing its connections to a battery source, and includes switch means, such as relay means 122 and 124, to control the direction of its operation. Such switch means are located inside the housing 12 and are controlled by signals produced by the radio receiving means in response to radio signals sent to the device 10 under control of the hunter. These radio signals will cause the motor 66 to operate either in the forward or reverse direction as desired. The motor 66 acting through the propeller 68 causes the device 10 to move through the water, the direction of movement being controlled by one or more rudders 76 and/or 77 or by the orientation of the motor 66 as will be explained hereinafter. It is also contemplated to use a motor 66 which has two or more operating speeds in each direction.

An antenna 74 extends from the housing 12 and is attached electrically to the radio receiving means 100 located in the housing 12, and the antenna 74 receives signals transmitted thereto from a remote location under control of operator control means 180, which will be described in more detail in conjunction with FIGS. 6 and 7. The antenna 74 is shown formed of a metallic rod which extends transversely across the housing 12 in a substantially horizontal configuration. This configuration facilitates placing and storing the device in a relatively small space such as in the trunk of a car or in a station wagon. It is contemplated, however, that the antenna 74 could be mounted on the device in a vertical orientation to improve the range of operation of the device 10, or the antenna 74 could be a resilient member of a member hingedly connected to the housing 12 so that it could be pulled down and attached to the housing when not in use.

Figure 4:
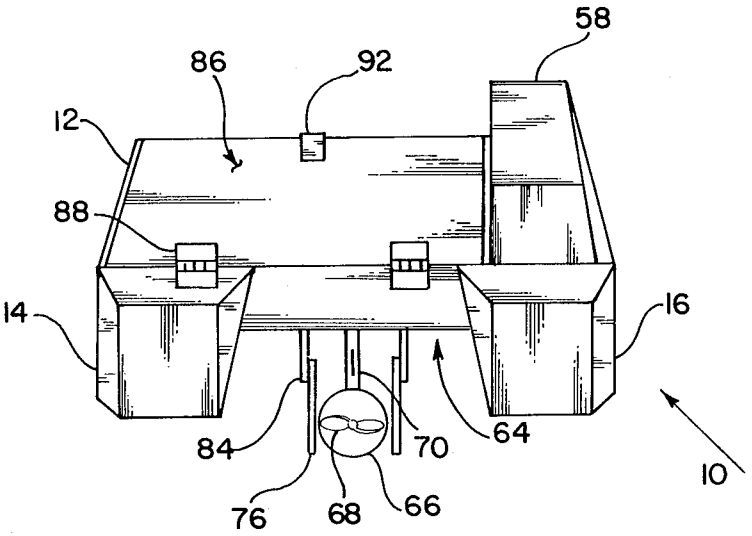
FIG. 4 is a rear elevational view of the same device.

Beneath the housing 12 rearwardly of the propeller 68 is a pair of similar, spaced-apart rudders 76 (FIGS. 3 and 4). The rudders 76 are mechanically linked to each other by a linkage 78 so that they move in concert, and the linkage 78 is connected by a shaft 80 to a solenoid or other motor mechanism 82 located in the housing 12 for the movement of said rudders. The solenoid 82 is connected to a control circuit 138, and the control circuit 138 receives signals from the receiver means 100 which are transmitted to it from the operator control means 180 as will be explained. These signals cause the solenoid or other motor 82 to move the rudders 76 about their vertical shafts 84 to some desired angular orientation relative to the midline of the device 10, thereby affecting turning and steering of the device 10 as it moves through the water. The use of two rudders has advantages in some cases, although a single rudder may also be used. It is also contemplated to use other steering means, one of which may be to rotate the drive motor 66.

Figure 8:
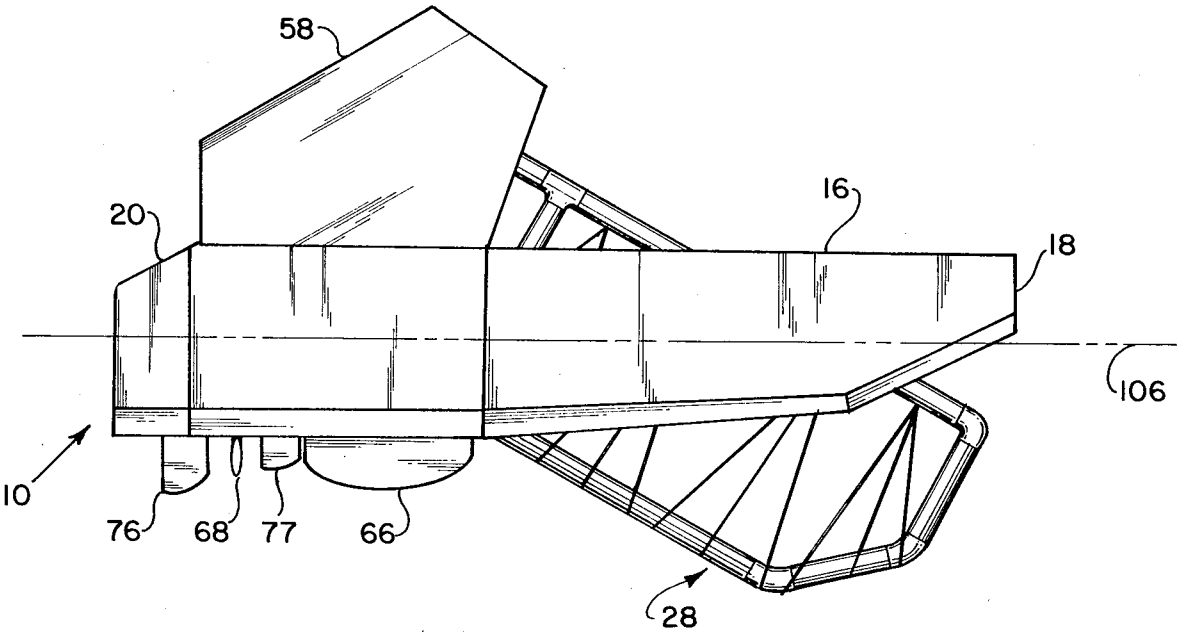
FIG. 8 is a side elevational view of the device of FIG. 1 including forward and rearward rudders.

FIG. 8 shows an embodiment containing the additional feature of a pair of forward rudders 77 located between the propeller 68 and the motor 66 to facilitate steering of the device as it is moving in the reverse direction. The propeller shaft 69 extending from the motor 66 is modified by lengthening and one forward rudder member 77 is placed on either side of such shaft. The forward rudders 77 operate in the same manner as the above described rear rudders 76, to which they are linked mechanically by linkages (not shown). These linkages assure that the movement of all rudder members is synchronized. The movement of the forward rudder pair 77 can be controlled by the same solenoid or motor mechanism 82 which controls the rear rudders 76.

Figure 2:
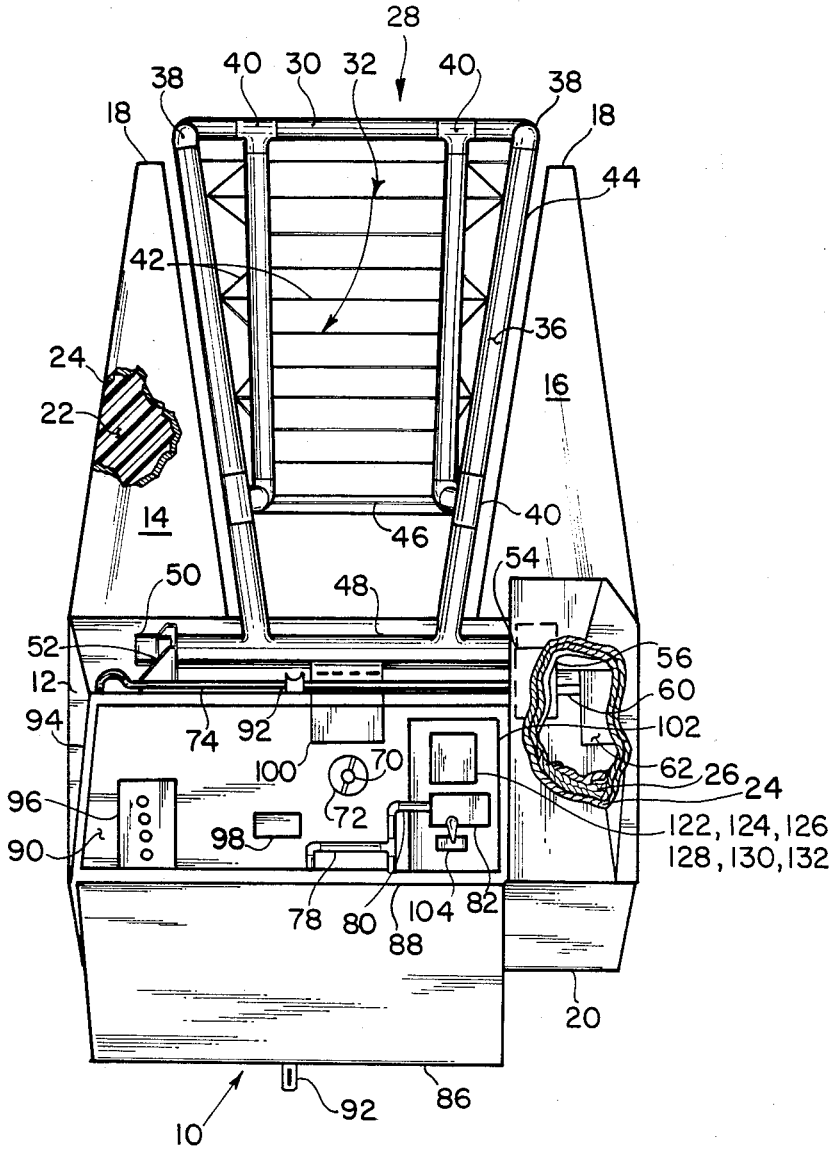
FIG. 2 is a top plan view of the device of FIG. 1 with the access door to the controls shown in open position.

FIG. 2 shows the present device from the top including showing the use of the access door 86 to the interior of the housing 12. The access door 86 is shown open and is hingedly attached to the housing 12 by hinge means 88 which extends along corresponding edges of the housing opening 90 and the door 86. The access door 86 is securable in closed position by latch means 92, one part of which is affixed to the housing 12 and the other part of which is affixed to the door 86. Located extending around the periphery of the opening 90 and/or the access door 86 are resilient gasket means 94, such as a rubber gasket, which affect a water-tight seal between the door 86 in the closed position and the housing 12 thereby preventing water from entering the housing 12. By sealing the door 86 closed, the components inside the housing 12 are protected even if the device should capsize or if the device is operated in rough water which would wash over the device.

Figure 5:
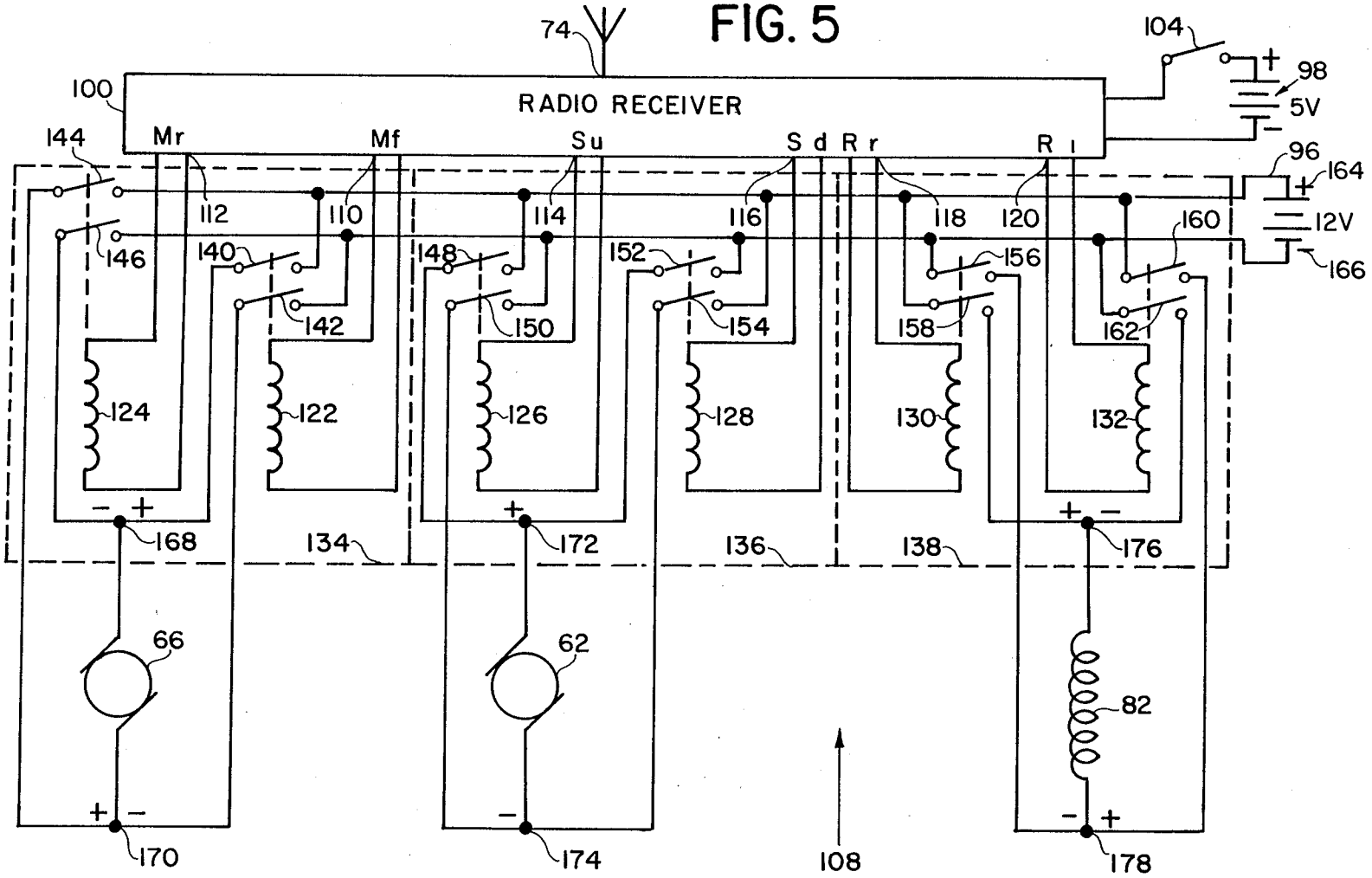
FIG. 5 is a circuit diagram of the electrical controls for the present device.

Inside the housing 12 are located the radio receiver means 100, a battery 96 such as a 12 volt storage battery to supply power for the propulsion motor 66, the rudder motor 82 and the rack motor 62, an optional battery 98 such as a 5 volt storage battery to supply power for the radio receiver 100, an optional control panel 102 containing switch mean 104 for switching power on and off to the radio receiver 100, control means 134, 136 and 138 for controlling operation of the drive motor 66, the rudder motor 82 and the rack motor 62, and other elements and connectors for connecting the various components together in operative condition, the interconnections and operation of which will be described in conjunction with FIG. 5. The above listed components are positioned within the housing for safety reasons and their weight and location in the housing helps to maintain the device 10 in balanced condition when it is on the water.

FIG. 3 shows the subject device 10 with the rack 28 in its lowered condition extending below the water surface 106 so that it is able to be moved under an object floating on the water surface 106, such as under a downed water fowl. When positioned in lowered position, and if necessary with the drive motor 66 operating in a forward direction to maintain force on the rack 28 against the water fowl, the remote control unit 180 is operated to cause the rack 28 to move upwardly, preferably to a position where the water fowl is completely raised above the water so as to prevent drag on the device as it is moving through the water. If all or part of the water fowl remains in the water it may effect the steering somewhat but this can be compensated for by proper adjustment of the orientation of the rudders 76.

FIG. 4 is a rear elevational view of the device 10 showing the spaced apart locations of pontoon members 14 and 16 and their connection to the housing 12, together with the position of the motor 66 and the propeller 68. The propulsion motor 66 and the propeller 68 are positioned to be as near to the surface of the water as possible while still remaining below the water surface so that the device can be used in relatively shallow water such as is found in many duck sloughs and the like. The rudders 76 are located rearwardly of the propeller 68 as aforesaid and are thus in the wake of the propeller 68 where they provide the best operation. The rudder members 76 are shown extending downwardly from the underside of the housing 12 and are linked mechanically as aforesaid and controlled by the solenoid or other motor means 82 located in the housing 12. The forward rudders 77, as shown in FIG. 8, are positioned to be in the wake of the propeller 68 when the drive motor 66 operates in reverse, thus providing more accurate and efficient steering during reverse movements of the device.

FIG. 5 is a simplified electrical diagram of one embodiment of control circuits 108 for the subject retrieving device 10. This includes the signal receiver means 100, which may be similar to those commonly used with model airplanes and the like, which receiver is connected to the antenna 74 and to the battery 98 which provides the power therefor. The receiver 100 is shown having output connections 110, 112, 114, 116, 118 and 120 on which output signals are produced to control the operation and direction of the drive motor 66, the rudder motor means 82 and the rack motor 62. A power switch 104 located on the control panel 102 is connected in the power input circuit of the receiver 100 to enable power from the battery 98 to be connected and disconnected to the signal receiver 100. When the power switch 104 is in "on" position and a modulated radio signal is received by the antenna 74, the signal receiver 100 generates various output command signals on its outputs 110, 112, 114, 116, 118 and 120. Six different modulations of the radio signal are preferably used which correspond to the six outputs, each modulation of the radio signal causing an output signal to appear on one of the six outputs. The six modulations include an $M_f$ modulation to cause the drive motor to operate in the forward direction, an $M_r$ modulation to cause the drive motor to operate in reverse, an $S_u$ modulation which causes the scoop motor to move the scoop upwardly, an $S_d$ modulation which causes the scoop to move downwardly, an $R_r$ modulation which causes the rudders to move toward positions where the device will turn rightwardly and an $R_l$ modulation which causes the rudders to move toward positions where the device will turn leftwardly. Each of the six outputs is used to energize respective ones of the relays 122, 124, 126, 128, 130 and 132 which relays have contacts which control how power from the battery 96 is supplied to the various operating members including the drive motor 66, the rudder movement means 82 and the rack moving means 62. The respective outputs 110, 112, 114, 116, 118 and 120 of the signal receiver 100, thus, cause power from the battery source 96, which may be a 12 volt wet cell battery, to be supplied in the desired polarity to the drive motor 66, the rack movement motor 62 and the rudder movement means 82.

In FIG. 5 the outputs 110, 112, 114, 116, 118 and 120 of the receiver 100 are shown fed as inputs to the relay-type control circuits 134, 136 and 138. It is contemplated, however, to make the controller circuits 134, 136 and 138 solid state to reduce their size and to eliminate the need for costly relays. Each control circuit 134, 136 and 138 is shown having two relays, each relay having a pair of normally open contacts, which, when closed, connect the battery 96 to the respective drive motor 66, scoop motor 62 or steering means 82 in the desired polarity. For example, control circuit 134 contains relay 122 connected to receiver output 110. In association with relay 122 are normally open contacts 140 and 142 which close when the relay 122 is energized by a signal on the output 110. Closed contacts 140 and 142 complete a power circuit between the battery 96 and the input terminals 168 and 170 of the drive motor 66. The relay 124 is also in control circuit 134. Normally open contacts 144 and 146 are operated by the relay 124 and close when said relay 124 is energized by a signal on output 112 of the receiver means 100. Closing of the contacts 144 and 146 completes a power circuit between the battery 96 and the power input terminals 168 and 170 of the drive motor 66. However, the polarity of the power supplied to the input terminals 168 and 170 by the closing of contacts 144 and 146 is the opposite of that supplied through the contacts 140 and 142. In other words, a signal on the output 110 will cause motor 66 to be energized by voltage of one polarity and a signal on output 112 will cause motor 66 to be energized by voltage of the opposite polarity. The construction of the control circuit 136 for the scoop motor 62 and the control circuit 138 for the rudder solenoid 82 can be essentially the same as the construction of the control circuit 134 and they can receive their power from the same battery source 96. The drive motor 66, the rudder solenoid or motor 82 and the scoop motor 62 preferably include reversible motors or similar devices so that they can be operated in either direction depending on the polarity of the battery voltage applied thereto. This is necessary in order to move the device in forward and reverse directions on the water, to turn it to the right or to the left, and to raise or lower the rack 28.

Referring to FIG. 5, forward operation of the device 10 is accomplished through the control circuit 134 for the drive motor 66 which includes a relay 122 to control the closing of a pair of the normally open relay contacts 140 and 142. When the radio signal modulation for drive motor forward operation $M_f$ is received by the radio receiving means 100, an $M_f$ control signal is produced on output 110 by the radio receiving means 100. The relay 122 is energized by such control signal from the receiver output 110, thereby establishing a power circuit from the terminals 164 and 166 of the battery 96 across the power input terminals 168 and 170 of the drive motor 66 through the relay contacts 140 and 142. This will cause the drive motor 66 to operate and to move the device 10 in the forward direction. When forward movement is no longer desired, transmission of the $M_f$ modulation is terminated thereby causing the output 110 to no longer energize the relay 122. This is caused by the contacts 140 and 142 returning to their normally open positions.

Reverse operation of the device 10 is accomplished in a similar manner. On receipt of a drive motor reverse modulation $M_r$, an $M_r$ control signal is produced on the receiver output 112. This energizes the relay 124 in drive motor control circuit 134 and causes normally open contacts 144 and 146 to move to their closed positions. A power circuit is thereby established between the terminals 164 and 166 of the battery 96 to the power inputs 168 and 170 of the drive motor 66 through the relay contacts 144 and 146. The difference between this circuit and the one established in the previously described forward operation is that positive terminal 164 of the battery 96 is connected electrically to input terminal 170 of the drive motor 66 through the relay 144 and the negative terminal 166 of the battery 96 is connected electrically to input 168 of the drive motor 66 through the relay 146 to reverse the polarity of the power connections. Thus it can be seen that operation of the relay 124 will the cause reversible drive motor 66 to run in the reverse direction and will have the effect moving the device 10 backwards on the water.

It is also contemplated to use one or more additional radio signal modulations and corresponding additional control circuit elements to enable the drive motor 66 to operate at two or more speeds in both the forward and reverse directions.

As indicated above, similar relay circuits can be included in the controllers 136 and 138 to control the energizing and direction of energizing of the rudder control means 82 and the rack moving means 62.

Figure 6:
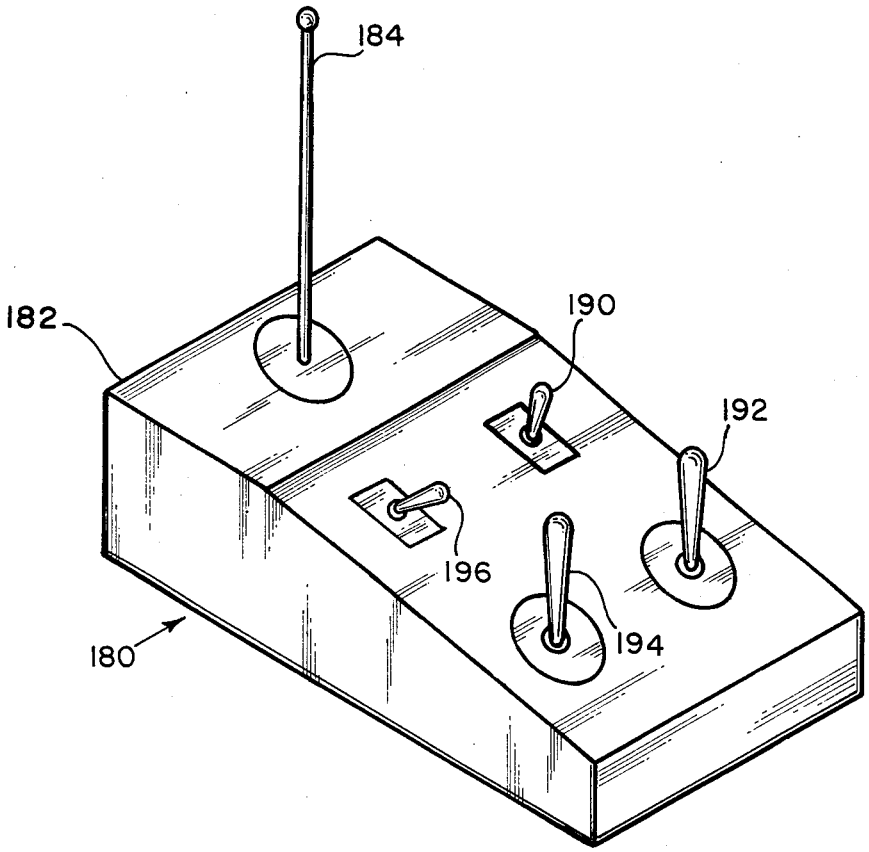
FIG. 6 is a perspective view of the operator's control device for remotely controlling the operation of the retriever device of FIGS. 1–5.

The transmitting controller device 180 is shown in FIG. 6 and includes a housing 182 which has a transmitting antenna 184 mounted thereon. The device 180 can be made as a hand held device or it can be constructed as shown to be placed on a supporting surface such as a ledge in a duck blind. The device 180 includes a transmitter circuit 186 with a suitable battery source 188, a power switch 196, and control switch members 190, 192 and 194 for causing the transmission of variously modulated signals to control the energization and direction of energization of the devices 62, 66 and 82. The switches 190, 192 and 194 are preferably three position switches or they can be spring loaded multi-position switches.

Figure 7:
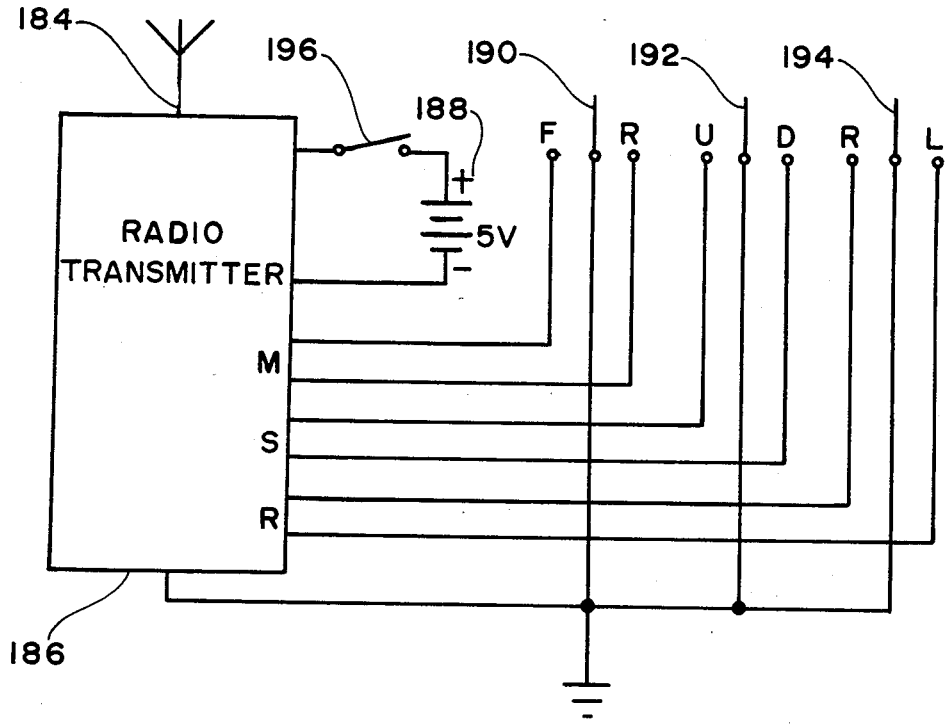
FIG. 7 is a circuit diagram of the electrical controls for the operator's control device.

FIG. 7 shows a simplified electrical circuit diagram of the transmitting controller device 180 of FIG. 6. The transmitting antenna 184 is electrically connected to the radio transmitter 186 and power is supplied to the transmitter 186 by the battery 188, such as a 5 volt wet cell battery, under control of on-off switch 196. The transmitter 186 in the embodiment shown is capable of generating signals that can be modulated to produce the one or more of the outputs, namely outputs $M_f$, $M_r$, $S_u$, $S_d$, $R_r$ and $R_1$, in response to operations of the switches 190, 192 and 194. The switches 190, 192 and 194 are preferably three-position switches as aforesaid, but in a more sophisticated system could be spring loaded joy sticks to provide speed control as well as direction control.

Once the device 10 has been, placed on the water and is manuevered to the desired location by operation of the motor switch 190 and the rudder switch 194, it is positioned facing the downed water fowl or other object to be lifted and transported. The rack switch 192 is then operated in a direction to move the rack 28 downwardly into the water and the device 10 is controlled to move it forwardly so that the rack 28 moves against the fowl and while so positioned the rack 28 is moved by operation of the switch 192 to a raised position lifting the fowl out of the water. The device 10 can now be maneuvered using the drive control switch 190 and the rudder control switch 194 to return it to the hunter.

In an embodiment with a multiple speed drive motor, the lower speeds may be used to control and maneuver the device while picking up a water fowl and the higher speeds to propel the device to the downed fowl and to return the device with the fowl to the hunter. The higher speeds may also be needed to overcome strong water currents or winds.

The subject retrieving device preferably has a relatively low profile on the water and is made as small as possible so as to produce minimal adverse effect on hunting such as by scaring birds that may be in the area. It may also be painted a camouflaging color and pattern. Because of the shape of the device it offers minimal resistance to movement on the water and it is minimally effected by the wind. It is also highly stable yet compact for ease of handling and transporting, and the device is buoyant and therefore will float even if overturned. The present device eliminates the need for having a dog to retrieve birds felled on water.

Thus there has been shown and described a novel device for retrieving floating objects such as downed water fowl from a body of water, which device fulfills all of the objects and advantages sought therefor. Many changes, modifications, variations and other uses and applications of the present construction will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A remotely controllable water supported device for retrieving objects such as water fowl from an open water surface comprising a housing structure including a pair of spaced apart buoyant pontoon portions having forward and rear ends, and a housing portion connected between the pontoons adjacent to the rear ends thereof, a scoop structure having an open front end, spaced opposite open sides and an open rear end, means connecting the scoop adjacent to the rear end thereof to the housing portion for movement relative thereto in the space between the pontoon portions, scoop drive means in the housing portion operatively connected to the means connecting the scoop structure to the housing portion to affect movements of the scoop structure, control means for the device and for the scoop drive means including a drive motor having a propeller attached thereto and means mounting the drive motor to the housing portion in the space between and below the pontoon portions adjacent the rear ends thereof, steering means pivotally connected to the housing portion and extending downwardly therefrom, motor means in the housing portion operatively connected to the steering means, a source of energy in the housing portion and means for selectively connecting the source of energy to energize the drive motor, the motor means and the scoop drive means, said means for selectively connecting including a control circuit having means for receiving a control signal transmitted thereto and means for demodulating the control signals received thereby into responses for energizing and deenergizing the drive motor, the motor means and the drive means to cause a desired operation to take place.

2. The device of claim 1 wherein said pontoon portions have upper and lower surfaces and said housing portion extends between and connects the upper surfaces of said pontoon portions.

3. The device of claim 1 wherein said scoop structure includes elongated connected members and web forming means extending therebetween to form bottom, side and rear supporting portions.

4. The device of claim 3 wherein said elongated connected members are formed of tubular members.

5. The device of claim 1 wherein said means connecting the scoop structure to the housing portion include pivotal means.

6. The device of claim 1 wherein the steering means comprises at least one rudder member located adjacent the said propeller.

7. The device of claim 1 wherein the control signal comprises a modulated radio signal.

8. The device of claim 1 including transmitter control means for the generation and transmission of the said control signal and means to modulate said control signal.

9. The device of claim 1 including a second source of energy and means for selectively connecting said second source to said means for receiving the control signal.

10. The device of claim 1 wherein said means for receiving the control signal includes radio signal receiving means and an associated antenna.

11. The device of claim 1 wherein said means for selectively connecting including means for predeterminately selecting the polarity of the connection between the source of energy and the respective drive motor, motor means and scoop drive means.

12. A device for guiding over a body of water to retrieve objects therefrom comprising a body structure formed by a pair of spaced buoyant pontoon portions having forward and rearward ends and shaped to facilitate their movement across the water, a housing portion extending between and connecting the pontoon portions adjacent to the rearward ends thereof at locations thereon spaced above the level of the water that is supporting the device, an open type lifting rack formed by connected members, means mounting the lifting rack for pivotal movement on the housing portion between a raised position extending forwardly therefrom in the space between the pontoon portions and a lowered position extending downwardly between the pontoon portions, moving means in the housing portion operatively connected to the lifting rack and energizable for moving the lifting rack between the raised and lowered positions thereof, an electric drive motor including a propeller and means for mounting the drive motor in spaced relation below the housing portion in position to be submerged in the water therebelow, a rudder assembly including a rudder member and means mounting the rudder member in position extending downwardly from the housing portion into the water adjacent to the propeller, motor means in the housing portion operatively connected to the rudder member to control the positional orientation thereof, electric control circuit means operatively connected to the drive motor, the motor means and the moving means for predeterminately controlling the energizing and direction of energizing thereof including a source of energy, and means in the housing portion for receiving transmitted radio control signals from a remote source, said receiving means including means to demodulate received radio control signals to produce signal response for controlling the connection between the source of energy and the drive motor, the motor means and the moving means.

13. The device of claim 12 wherein the electric drive motor is a trolling motor.

14. The device of claim 12 wherein the lifting rack moving means includes an electric motor and associated gear reducer mechanism.

15. The device of claim 12 wherein the lifting rack is formed of a network of elongated connected members forming an open sided rack structure and strands of a thread like material wound on the elongated connected member forming an open grid thereon.

16. The device of claim 12 wherein the rudder assembly has a pair of spaced parallel rudder members and means connecting the rudder members for movement in concert.

17. The device of claim 12 wherein the drive motor, motor means and moving means each includes a reversible motor.

18. The device of claim 12 wherein the rudder assembly includes rudder members located forwardly and rearwardly of said propeller and means connecting said rudder members for movement in concert.

* * * * *